US005181574A

United States Patent [19]

Dion

[11] Patent Number: 5,181,574

[45] Date of Patent: Jan. 26, 1993

[54] SCRAPER BLADE MOUNT FOR BULLDOZER

[76] Inventor: Fernand Dion, 195, route 138, Saint-Augustin, Canada, G3A 1W3

[21] Appl. No.: 802,213

[22] Filed: Dec. 4, 1991

[51] Int. Cl.[5] ..... E02F 3/76

[52] U.S. Cl. ..... 172/816; 172/824

[58] Field of Search ..... 172/811, 816, 821, 822, 172/823, 824, 825, 826, 830, 831; 37/234, 235, 236

[56] References Cited

U.S. PATENT DOCUMENTS

| | | | |
|---|---|---|---|
| 2,839,849 | 6/1958 | Christensen et al. | 172/824 |
| 3,018,573 | 1/1962 | McAdams | 172/824 |
| 3,590,929 | 7/1971 | Wirt | 172/824 |
| 3,653,451 | 4/1972 | Fryreur et al. | 172/804 |
| 3,662,841 | 5/1972 | Molby et al. | 172/824 |
| 3,698,490 | 10/1972 | King | 172/824 |
| 3,820,610 | 6/1974 | Fryrear et al. | 172/826 |
| 3,998,277 | 12/1976 | Wirt | 172/826 |
| 4,019,588 | 4/1977 | Casey | 172/824 |
| 4,083,414 | 4/1978 | Yokoyama et al. | 172/804 |

*Primary Examiner*—Randolph A. Reese
*Assistant Examiner*—Jeffrey L. Thompson
*Attorney, Agent, or Firm*—Pierre Lespérance; Francois Martineau

[57] ABSTRACT

A bulldozer is provided with a ground scraping blade. The blade is supported to the chassis of the vehicle by a pivoted frame. The frame can be power displaced relative to the supporting chassis by a first pair of inclined rams, providing translational motion of the blade. A ram power displaces the blade in rotation relative to the pivoted frame. Another ram, extending vertically, interconnect the vertically spaced rear ends of a pair of helicoidal, diverging, sinusoidal arms forming part of the pivot frame with the front ends thereof anchored to the blade in horizontally spaced fashion. Extension of the latter ram induces relative motion of the pair of helicoidal arms so that one lateral side end of the blade will lift exclusively of the opposite lateral side end thereof.

5 Claims, 4 Drawing Sheets

SCRAPER BLADE MOUNT FOR BULLDOZER

FIELD OF THE INVENTION

This invention relates to means for operatively interconnecting and power handling a ground scraping blade to a bulldozer.

BACKGROUND OF THE INVENTION

Bulldozers conventionally carry at their front ends a large ground-engageable blade, for scraping granular material (earth, snow, . . . ) from the ground or for leveling the latter. The blade is supported in generally vertical position, with its bottom edge destined to engage the ground. The blade height is usually controlled by a first ram means, while the relative inclination of the blade can be controlled by a second ram means. In some bulldozers, third ram means are provided to lift one lateral end of the blade relative to the opposite lateral end, to expand the capabilities of the bulldozer: e.g. to work with a corner only of the blade to unearth a large ground-embedded rock, or to provide an inclined bottom leading edge to produce a radially outwardly raised ground surface in a curved section of a snow-based road.

For example, U.S. Pat. No. 2,839,849 issued in 1958 to Clark Equipment Co., discloses thrust means 78 at the mid portion of a bulldozer blade 58, being adapted to resiliently deform or warp the blade forwardly or rearwardly to effect a downward or upward tilting movement of the cutting edge of the blade. These thrust means consists in a hydraulic ram 78 located between the two main, blade lifting, hydraulic rams 100, 106. Opposite lateral telescopic struts 150, 170 load the blade to the chassis of the bulldozer. The bulldozer operator, by engaging a pin 186 into a slot of telescopic strut 170, and energizing intermediate ram 78, will bias the blade in becoming warped since the unlocked strut 150 can extend but not the locked struts 170, whereby the lateral end of the blade in register with the opposite strut 150 will lift. Such a procedure is inefficient, in that the operator must leave his seat in the bulldozer cabin to engage or release the pin 186, each time lateral tilting of the bade is required. Moreover, warping of a blade is possible only if this blade is made sufficiently flexible and thin, which thus limit its durability and reduce the maximum load capability of the blade. Indeed, it is obvious that blade warping will tend to compromise the structural integrity of the blade, with time and wear.

U.S. Pat. Nos. 3,653,451 issued in 1972 to Caterpillar tractor co., and No, 4,019,588, are similar to the above-noted patent in that they provide lateral tilt capability for a blade thanks to blade warping means.

OBJECTS OF THE INVENTION

The gist of the invention is therefore to provide improved means for lateral tilting of a bulldozer blade, in a way which does not warp the blade.

A general object of the invention is to increase the useful lifetime of bulldozer blades equipped with lateral tilting means.

A corollary object of the invention is to reduce weight and volume of lateral tilt devices for bulldozer blades, as well as the maintenance costs therefor.

SUMMARY OF THE INVENTION

In accordance with the object of the invention, there is disclosed a coupling device for loading a ground scraping blade frontwardly of a bulldozer, said bulldozer of the type having a chassis rollingly supported over ground and carrying an operator's cockpit, said bade of the type having a planar main 10, body destined to stand generally transversely to the ground in the operative position of the scraping blade and defining one and another opposite lateral side end portions, said coupling device comprising: (a) first means for supporting said blade onto a front portion of said chassis; (b) second means for relative movement of said blade about said chassis; (c) third means for power lifting said one of said lateral side end portions of said blade exclusively of said another lateral side end portion thereof, said third means being of a non blade warping type; and (d) remote control means, for operating said third power means remotely by said operator in said cockpit.

More particularly, it is envisioned that said first means consists of a planar support member defining front and rear ends, said support member front end endwisely mounted to said blade; said second means consisting of connector means, for pivotally interconnecting said support member front end to said blade, and a first pivot member, mounted to said support member rear end and destined to pivotally engage a front portion of said bulldozer chassis; said third means consisting of a pair of elongated, sinusoidal, helicoidal, first and second bars, each said bar defining a front and a rear end, said bars front ends being anchored to said support member front end in laterally spaced apart fashion, said bars rear ends being positioned in transversely spaced register with one another whereby said bars converge at their rear ends, said first bar rear end being located generally above said second bar rear end; and further including power ram means, pivotally interconnecting said bars rear ends for relative displacement of said second bar rear end away from or toward said first bar rear end about an axis generally transverse to a plane intersecting said planar support member; wherein extension of said ram means to displace said second helicoidal bar rear end away from said first helicoidal bar rear end inducing lift of the blade lateral side end portion on the side of said first bar front end exclusively of the blade opposite lateral side end portion.

DETAILED DESCRIPTION OF THE INVENTION

Figure 1:
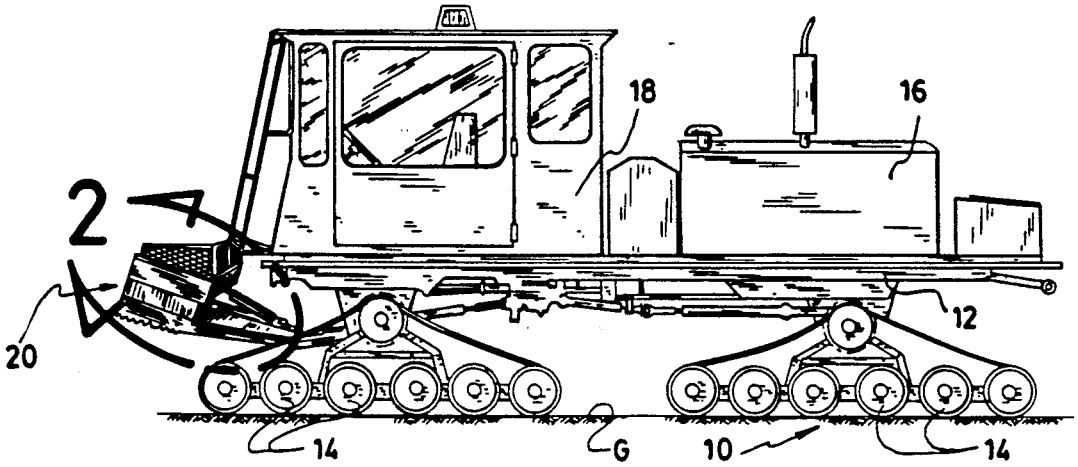
FIG. 1 is a side elevation of a bulldozer provided with a scraper blade mount of the invention.
Figure 2:
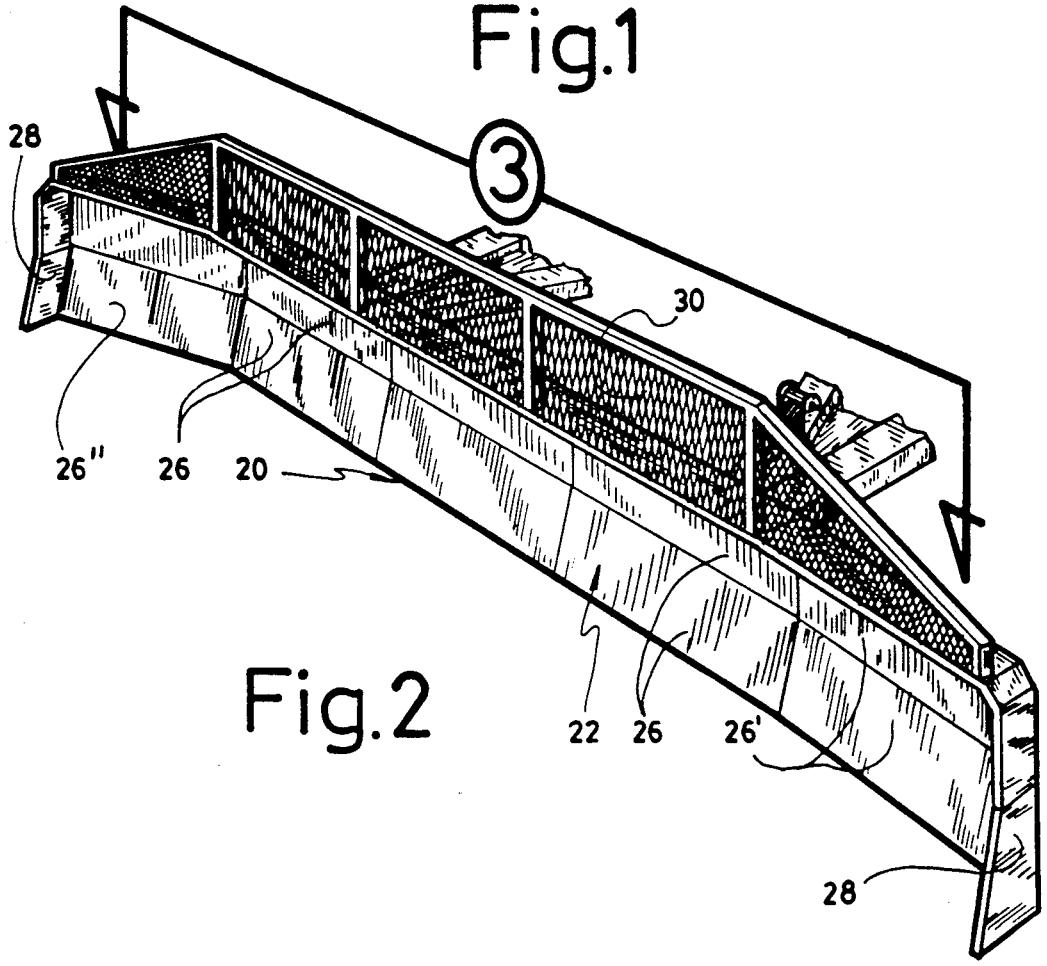
FIG. 2 is a front perspective view of the scraper blade.
Figure 3:
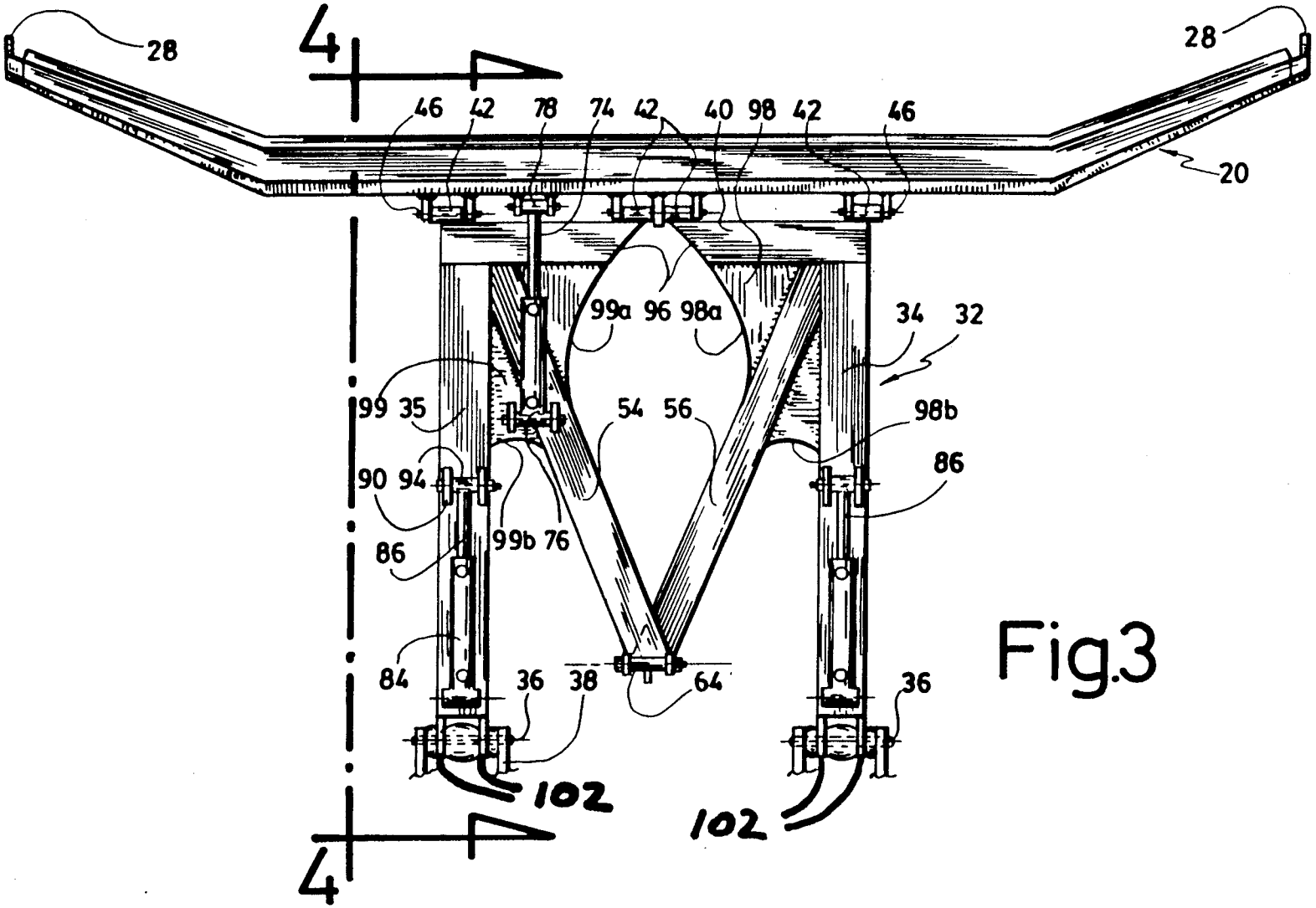
FIG. 3 is a top plan view of the scraper blade mount.

Bulldozer 10 consists of a chassis 12 supported by racked wheels 14 and carrying a rear power train 16 and a front cabin 18. A large, ground scraping blade 20 is mounted frontwardly of cabin 18 by a mount means 32, detailed below. Scraper blade 20, best illustrated in FIGS. 2 and 3, is of conventional make, consisting of an elongated, thin, generally rectangular plate member 22 with one lengthwise straight edge thereof 24*a* facing downward and constituting the leading edge. Blade 20 is to be supported vertically over ground G and blade leading edge 24*a* is destined to engage the ground G.

Upon energizing power train 16, the bottom blade edge 24*a* is to be pushed transversely along the ground G for smoothing, roughing or removing an outer layer of earth, snow or the like material. This scraped material is then captured and pushed by the front wall of the frontwardly moving blade plate member 22, to gather and discharge same laterally away from the path of travel of the bulldozer.

Blade 20 may consist of a number of edgewisely anchored, generally coplanar, quadrangular plates 26 (FIG. 2) with the end plates 26', 26'' being forwardly outwardly inclined by a small acute angel (FIG. 3), to retain the scraped ground material generally in frontward register with the blade 22. To increase the load carrying capability of the scraper blade 20, frontwardly projecting integral flanges 28 depend from the small side edges 24*b*, 24*c* thereof, and an integral metallic lattice 30 projects upwardly from the top lengthwise edge 24*d* of the blade 20. The particular blade construction is not critical to the present invention.

Accordingly with the teachings of the invention, blade mount 32 includes a pair of elongated rigid arms 34, 35, each carrying a coextensive yoke 102. Each yoke 102 is endwisely pivoted by horizontal pivot axles 36 to a pair of ears 38 projecting from the chassis 12. Each corresponding pair of ears 38 from the bulldozer vehicle are spaced by an inner gap being substantially greater than the exterior width of a given yoke 102. Therefore, the yoke 102 is freely slidable along the horizontal pivot axle 36, for a limited side play between the two ears 38 from a pair of proximate ears 38. This side play of yoke 102 within a pair of ears 38 will allow the opposite end of the corresponding parallel arms 34 or 35, to raise or lower, under the bias of vertically extending hydraulic ram 60, raising or lowering the corresponding ends of diverging arms 54 and 56, without any structural stress being induced.

Between the front ends of forwardly extending arms 34 extends a transverse arm 40, joining the forward ends of support arms 34. A number of yoke 40, joining the forward ends of support arms 34. A number of yoke members 42 are anchored to the rear wall of blade panel 26, in colinear transverse arrangement. Transverse arm 40 includes a number of frontwardly extending, transverse ears 44, wherein a pivot axle 46 pivotally interconnects each yoke 42 to a corresponding ear 44. Axles 36 and 46 are parallel to one another.

Figure 4:
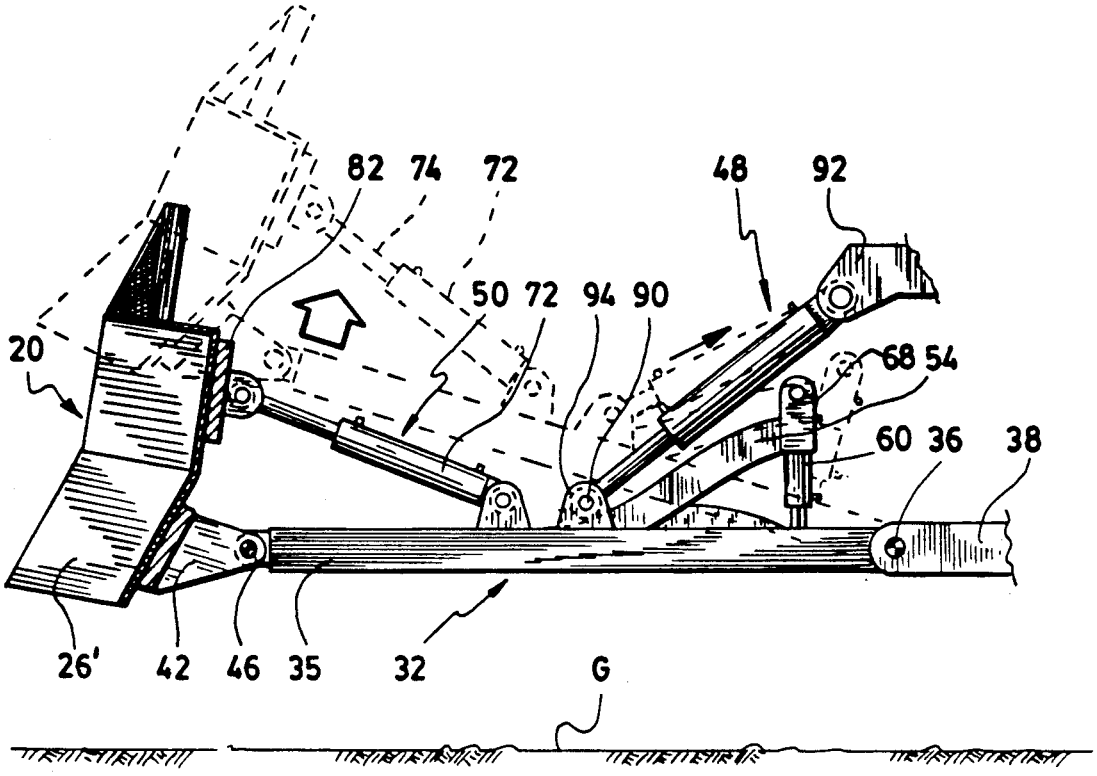
FIGS. 4 and 4*a* are partly sectional elevational views of the scraper blade mount, taken along line 4—4 of FIG. 3 and suggesting the relative movement of the scraper blade enabled by the present invention blade mount.
Figure 4A:
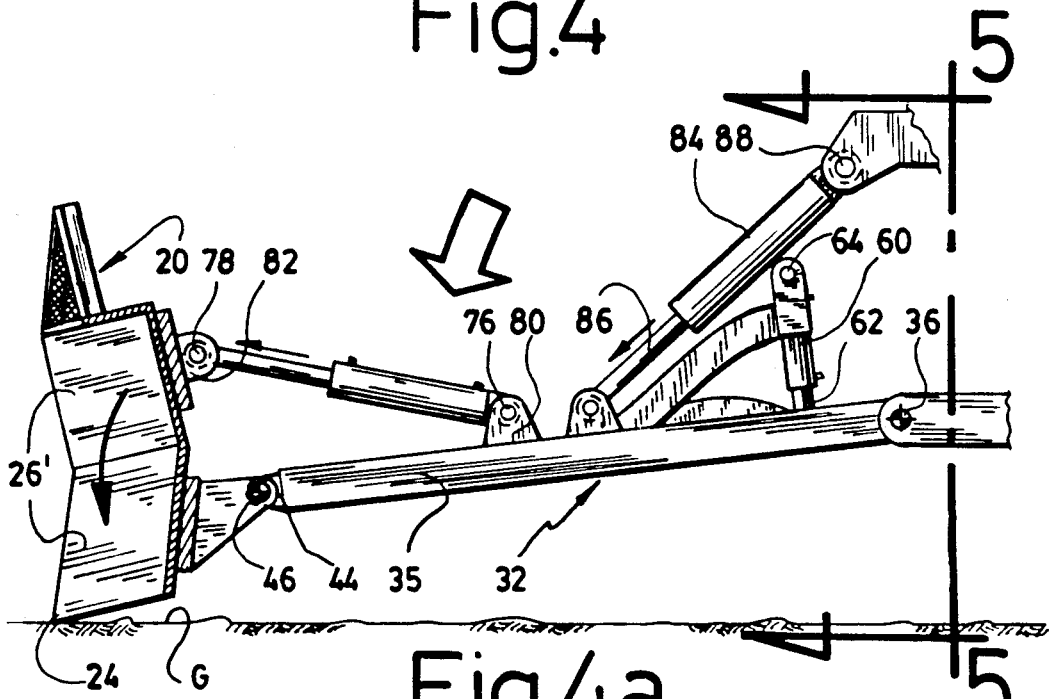

As best seen in FIGS. 4 and 4*a*, first power means 48 are provided to pivot arms 34 relative to chassis 12, about axles 36, wherein blade 20 will be lifted; while second power means 50 are provided to tilt blade 20 relative to support arms 34, about axles 46. Thus, first power means 48 provides translational pitch motion for blade 20, while second power means 50 provides rotational pitch (or fore and aft tilt) motion therefor. Power means 46, 50 will be detailed later.

Figure 5:
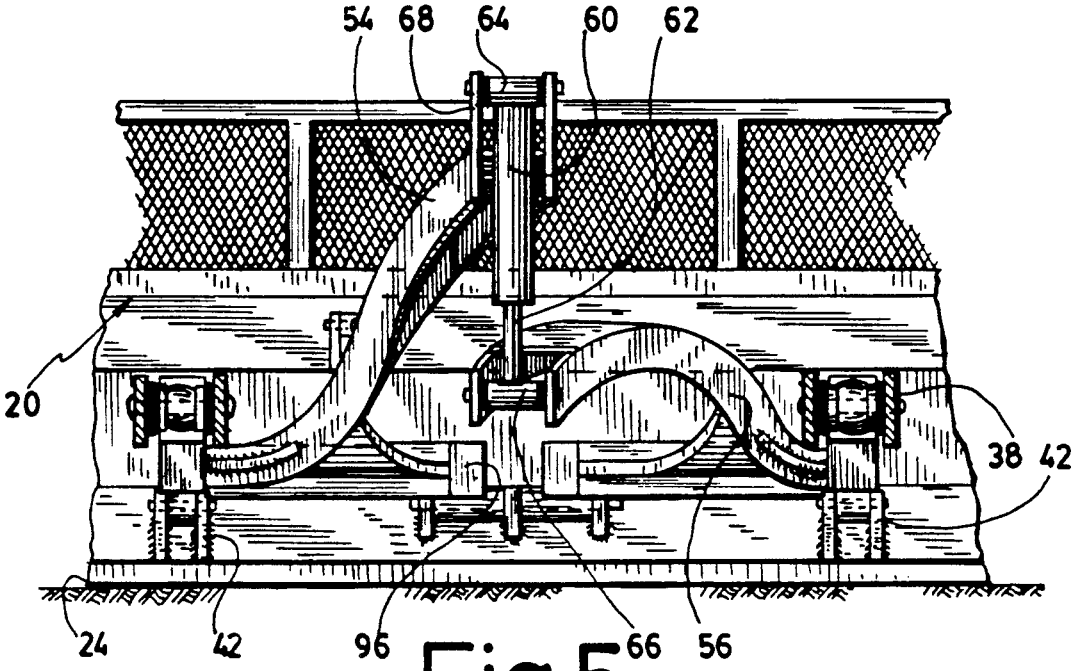
FIGS. 5 and 5*a* are rear elevations of the scraper blade, taken along line 513 5 of FIG. 4*a*, clearly showing the pair of diverging helicoidal bars and sequentially suggesting, as the vertical ram is extended, the lateral tilt capability of the scraper blade.
Figure 5A:
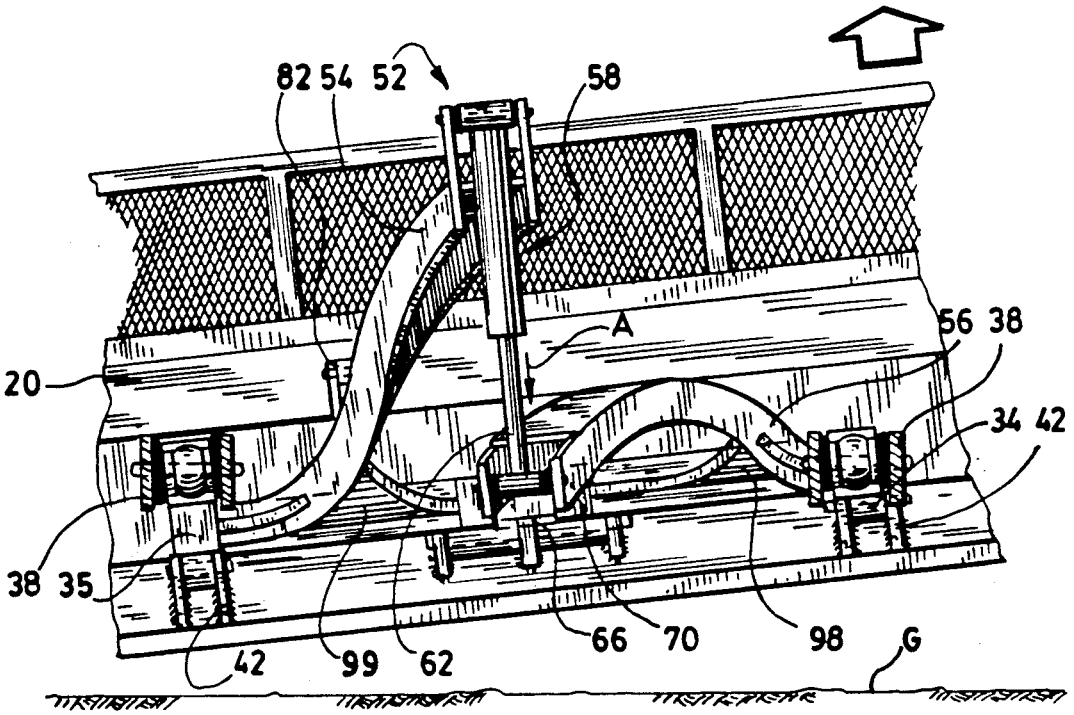

As suggested in FIGS. 3 and 5–5*a*, and accordingly with the heart of the invention, there is further provided power means 52 for lateral tilting of the blade 20, i.e. for lifting one lateral side end of the blade exclusively of the other (opposite) lateral side end thereof. Tilt means 52 consists of sturdy bars 54, 56 arranged generally in a diverging, V-shape from a plan view (FIG. 3). Bar 54 is anchored at its front end to the meeting ends of arms 35 and 40, and bar 56 is endwisely anchored frontwardly to the meeting ends of arms 34 and 40, whereas bars 54 and 56 are interconnected at their rear ends by a transverse vertically extending ram member 58. Each bar 54, 56 may be cross-sectionally U-shape, for reducing their weight, with the mouth facing generally downward to the ground. Connector 58 is a hydraulic ram, extending vertically intermediate parallel blade support arms 34 and 35, and defining an upper cylinder 60 and a bottom piston rod 62 extending downwardly from cylinder 60.

Transverse pivot axles 64, 66 are carried at the free ends of cylinder 60 and piston rod 62 respectively. Integral yokes 68, 70 interconnect the rear end of bar 54 to pivot axle 64, and the rear end of bar 56 to pivot axle 66, respectively. The axes of pivot axles 64, 66 extend parallel to the plane joining blade support arms 34, 35 but orthogonally to the fore and aft axes thereof.

Second power means 50 also consists of a ram, defining a rear cylinder 72 and a fore piston rod 74 extensible forwardly the free ends of cylinder 72 and piston rod 74 respectively. Pivot axles 76 depends from a yoke member 80 anchored to the top pivot axle 78 depends from another yoke member 82 anchored to the rear wall of blade panel 26 above yokes 42. Axles 76 and 78 extend parallel to axle 46.

It can now be understood that, as piston rod 62 is extended—arrow A in FIG. 5*a*—from a retracted position—FIG. 5—, the lower arm 56 will be lowered at its rear end. Since the upper arm 54 is anchored at its intermediate section to blade 20—by ram 50—and at its lower front end to same blade, upper arm 54 will not bulge. Hence, the front end of lower arm 56 will have to raise—see the wide arrow in FIG. 5*a*—to compensate for the lowering of its rear end. The lateral side end corner of the blade corresponding to the side of the front end of lower arm 56, will thus lift from ground up to a certain level, e.g. one foot.

First power means 48 consists of a pair of rams, one over each main, blade support arm 34, 35. Each ram 48 defines an upper cylinder 84 and a lower, frontward piston rod 86. The free end of each cylinder 84 and rod 86 carries a transverse pivot axle 88, 90 respectively. Each pivot axle 88 is dependent from. An ear 92 integral to chassis 12, ear 92 generally overlying ears 38. Each pivot axle 90 is dependent from a yoke member 94, projecting from the top wall of an intermediate section of a corresponding support arm 34 or 35, at a location rearward of yoke 80.

Referring particularly to FIGS. 3 and 5, there is clearly shown that transverse arm 40 is sectioned at its intermediate section, forming a V-shape cut-out 96. Additionally, the endwisely merging end sections of each pair of orthogonal arms 34, 40 and arms 35, 40 respectively are transversely interconnected by a metallic sheet 98, 99. Moreover, the rear portion of helicoidal arm 56 lengthwisely merges with sheeting 98, while the rear portion of helicoidal arm facing concavo-concave edges 98*a*, 99*a*, on the rearward inward side thereof, and concave edges 98*b*, 99*b* on their rearward outward sides. Arcuate edges 98*a*, 99*a* are coextensive with V-edges 96, 96 of transverse arm 40.

Such a sheet construction 98, 99 could enhance the lateral tilting capability of the blade 20 upon actuation of the vertical ram 60 for movement of the rear end of helicoidal arm 56 relative to the rear end of arm 54.

I claim:

1. A coupling device loading a ground scraping blade frontwardly of a bulldozer, said bulldozer of the type having a chassis rollingly supported over ground and carrying an operator's cockpit, said blade of the type having a planar main body destined to stand generally transversely to the ground in the operative position of the scraping blade and defining one and another opposite lateral side end portions, aid coupling device comprising:

(a) first means for supporting said blade onto a front portion of said chassis;

(b) second means for relative movement of said blade about aid chassis;

(c) third means for power lifting said one of said lateral side end portions of said blade exclusively of said another lateral side end portion thereof, said third means being of a non blade warping type; and (d) remote control means, for operating said third power means remotely by said operator in said cockpit; further including fourth means, for power lifting both lateral end portions of said blade at the same rate, said remote control means operatively connected to said fourth means, and fifth means, for power tilting said blade about a fore and aft tilt motion to vary the general inclination of said blade relative to the ground, said remote control means operatively connected to said fifth means;

wherein said first means consists of a planar support member defining front and rear ends, said support member front end endwisely mounted to said blade; said second means consisting of connector means, for pivotally interconnecting said support member front end to said blade, and a first pivot, mounted to said support member rear end and destined to pivotally engage a front portion of said bulldozer chassis; said third means consisting of a pair of elongated, first and second bars, each said bar defining a front and a rear end, said bars front ends being anchored to said support member front end in laterally spaced apart fashion, said are rear ends being positioned in transverse alignment with one another whereby said bars converge at their rear ends, said first bar rear end being located generally above said second bar rear end; and further including power ram means, pivotally interconnecting said bars rear ends for relative displacement of said second bar rear end away from or toward said first bar rear end along a line generally transverse to a plane intersecting said planar support member; wherein extension of said ram means to displace said second bar rear end away from said first bar rear end including lift of the blade lateral side end portion on the side of said first bar front end exclusively of the blade opposite lateral side end portion.

2. A blade coupling device as defined in claim 1, wherein each one of said bars is tubular and of cross-sectionally U-shape, the mouth of the U-bars generally facing toward the ground.

3. A blade coupling device as defined in claim 2, wherein said power ram means includes a cylinder, having a transverse second pivot member at its free end which pivotally interconnects said first bar rear end to said cylinder, and a piston rod reciproctable into said cylinder and carrying a third transverse pivot member at its free end, said third pivot member pivotally interconnecting said second bar rear end to said piston rod; wherein said first, second and third pivot members define pivotal axles parallel to one another; said power ram means piston rod displaceble along an axis orthogonal to said planar 4. A blade coupling device as defined in claim 3, wherein said means for interconnecting said support member to said blade includes said fifth means, defining a ram means including a cylinder pivoted to an intermediate section of said support member by a fourth pivot member, and a piston rod reciproctable into the latter cylinder and pivoted at its free end to said blade by a fifth pivot member, said fourth and fifth pivot members defining pivotal axles parallel to those of said first to third pivot members.

5. A coupling device for loading a ground scraping blade frontwardly of a bulldozer, said bulldozer of the type having a chassis rollingly supported over ground and carrying an opeator's cockpit, said blade of the type having a planar main body destined to stand generally transversely to the ground in the operative position of the scraping blade and defining one and another opposite lateral side end portions, said coupling device comprising:

(a) first means for supporting said blade onto a front portion of said chassis;

(b) second means for relative movement of said blade about said chassis;

(c) third means for power lifting said one of said lateral side end portions of said blade exclusively of said another lateral side end portion thereof, said third means being of a non blade varying type; and (d) remote control means, for operating said third power means remotely by said operator in said cockpit;

wherein said first means consists of a planar support member defining front and rear ends, said support member front end endwisely mounted to said blade; said second means consisting of connector means, for pivotally interconnecting said support member front end of said blade, and a first pivot member, mounted to said support member rear end and destined to pivotally engage a front portion of said bulldozer chassis; said third means consisting of a pair of elongated, first and second bars, each said bar defining a front and a rear end, said bars front ends being anchored to said support member front end in laterally spaced apart fashion, said bars rear ends being positioned in transverse alignment with one another whereby said bars converge at their rear ends, said first bar rear end being located generally above said second bar rear end; and further including power ram means, pivotally interconnecting said bars rear ends for relative displacement of said second bar rear end away from or toward said first bar rear end along a line generally transverse to a plane intersecting said planar support member; wherein extension of said ram means to displace said second bar rear end away from said first bar rear end inducing lift of the blade, lateral side end portion on the side of said first bar front end exclusively of the blade opposite lateral side end portion.

* * * * *